United States Patent [19]

Lundal et al.

[11] Patent Number: 4,818,025

[45] Date of Patent: Apr. 4, 1989

[54] NARROW OPENING MECHANICAL MINER

[75] Inventors: Mandius C. Lundal, Spokane, Wash.; Fred W. Brackebusch, Kellogg, Id.

[73] Assignee: Hecla Mining Company, Coeur D'Alene, Id. ; a part interest

[21] Appl. No.: 931,199

[22] Filed: Nov. 14, 1986

[51] Int. Cl.[4] ..... E21C 29/00; E21C 31/10

[52] U.S. Cl. ..... 299/31; 405/148

[58] Field of Search ..... 299/31–33, 299/1; 405/142, 148; 180/8.1, 8.5

[56] References Cited

U.S. PATENT DOCUMENTS

| | | | |
|---|---|---|---|
| 3,314,722 | 4/1967 | Webster | 299/31 |
| 3,345,108 | 10/1967 | Newman et al. | 299/31 |
| 3,383,138 | 5/1968 | Scaravilli et al. | 299/31 |
| 3,415,574 | 12/1968 | Lauber | 299/31 |
| 3,433,533 | 3/1969 | Webster | 299/56 |
| 3,437,380 | 4/1969 | Lawrence | 299/10 |
| 3,469,884 | 9/1969 | Kampf-Emden | 299/33 |
| 3,498,675 | 3/1970 | Kampf-Emden et al. | 299/31 |
| 3,516,258 | 6/1970 | Boland | 405/148 |
| 3,598,445 | 8/1971 | Winberg | 299/31 |
| 3,695,717 | 10/1972 | Birrer | 299/31 |
| 3,713,700 | 1/1973 | Montacie | 299/31 |
| 3,754,790 | 8/1973 | Mappin et al. | 299/31 |
| 3,784,257 | 1/1974 | Lauber et al. | 299/31 |
| 3,828,862 | 8/1974 | Dabell et al. | 299/33 X |
| 3,840,271 | 10/1974 | Sugden | 299/31 |
| 3,863,989 | 2/1975 | Voitsekhovsky et al. | 299/31 |
| 3,957,310 | 5/1976 | Winberg et al. | 299/31 |
| 3,979,151 | 9/1976 | Plummer | 299/31 |
| 4,113,316 | 9/1978 | Phillips et al. | 299/31 |
| 4,136,910 | 1/1979 | Plummer | 299/31 |
| 4,302,054 | 11/1981 | Haskew et al. | 299/31 |
| 4,312,541 | 1/1982 | Spurgeon | 299/31 |
| 4,332,420 | 6/1982 | Coski | 299/31 |
| 4,343,512 | 8/1982 | Heitkamp et al. | 299/1 |
| 4,363,519 | 12/1982 | Howard | 299/31 |
| 4,449,755 | 5/1984 | Nelson | 299/31 |
| 4,486,050 | 12/1984 | Snyder | 299/18 |

*Primary Examiner*—Jerome W. Massie, IV
*Assistant Examiner*—David J. Bagnell
*Attorney, Agent, or Firm*—Wells, St. John & Roberts

[57] ABSTRACT

A self-propelled mining vehicle is disclosed which is self supporting above the floor of a mine tunnel. The vehicle is adapted to be supported above the floor of the mine tunnel such that conventional rock removing vehicles are operable therebeneath. The vehicle has an elongated carrier or frame having a mining apparatus mounted at one end. Four transverse bracing cap assemblies are included, and are adapted to engage side walls of a mine tunnel for supporting the carrier above the tunnel floor. Four suspension links extend downwardly from each cap assembly for suspending the carrier beneath the cap assemblies. The suspension links are longitudinally movable with respect to the carrier and cap assemblies for causing movement of the carrier and cap assemblies relative to one another. With such a construction, the vehicle is able to hold its position above a mine tunnel floor without contacting the floor. The vehicle is also able to walk along mine tunnel walls to travel fore and aft, and up and down, within a mine tunnel. Additionally, the vehicle is able to change its heading for travelling along a curved mine tunnel or vein.

12 Claims, 10 Drawing Sheets

NARROW OPENING MECHANICAL MINER

TECHNICAL FIELD

This invention relates generally to mining equipment, and more particularly to self-propelled mining equipment which operates in mine stopes, tunnels or cavities.

BACKGROUND OF THE INVENTION

Mining of rock is performed using a variety of methods. One method includes drilling and blasting. The material loosely separated by the blasting is removed using trains or other motorized equipment which operate along a mine tunnel. Another method employs commercially available high energy hydraulic picks for breaking the rock, then removing the material with such motorized equipment.

Other methods employ large mining vehicles which tunnel or bore their way through the rock. Large mining machines for mining or forming a tunnel are shown for example in U.S. Pat. Nos. 3,598,445 to Winberg; 3,754,790 to Mappin et al.; 4,312,541 to Spurgeon; 4,363,519 to Howard; and 4,486,050 to Snyder. Such tunneling machines are designed to excavate tunnels of constant cross-sectional size, which are relatively straight or excavated with large radius turns. The tunnels are generally designed to transport water, provide ventilation or move traffic. The tunneling machines integrate gathering and loading devices for handling the broken and fragmented material, and have conveying mechanisms for moving the fragmented material from the working face to the back of the tunneling machine.

Some veins of rock are not readily mineable by use of any of the equipment described in the foregoing patents. For example, some veins vary from a few inches to eight or ten feet wide and wander in a serpentine way through the earth. The machinery described in the foregoing patents does not appear to be readily adaptable to mine a narrow meandering vein.

Accordingly, there remains a need for a mining vehicle which is operable in narrow width mine tunnels, capable of serpentining its way along a curvy vein of rock, and enables easy removal of the broken rock which is mined by the vehicle.

BRIEF DESCRIPTION OF THE DRAWINGS

The preferred embodiment of the invention is illustrated in the accompanying drawings, in which.

DETAILED DESCRIPTION OF THE PREFERRED EMBODIMENT

Figure 1:
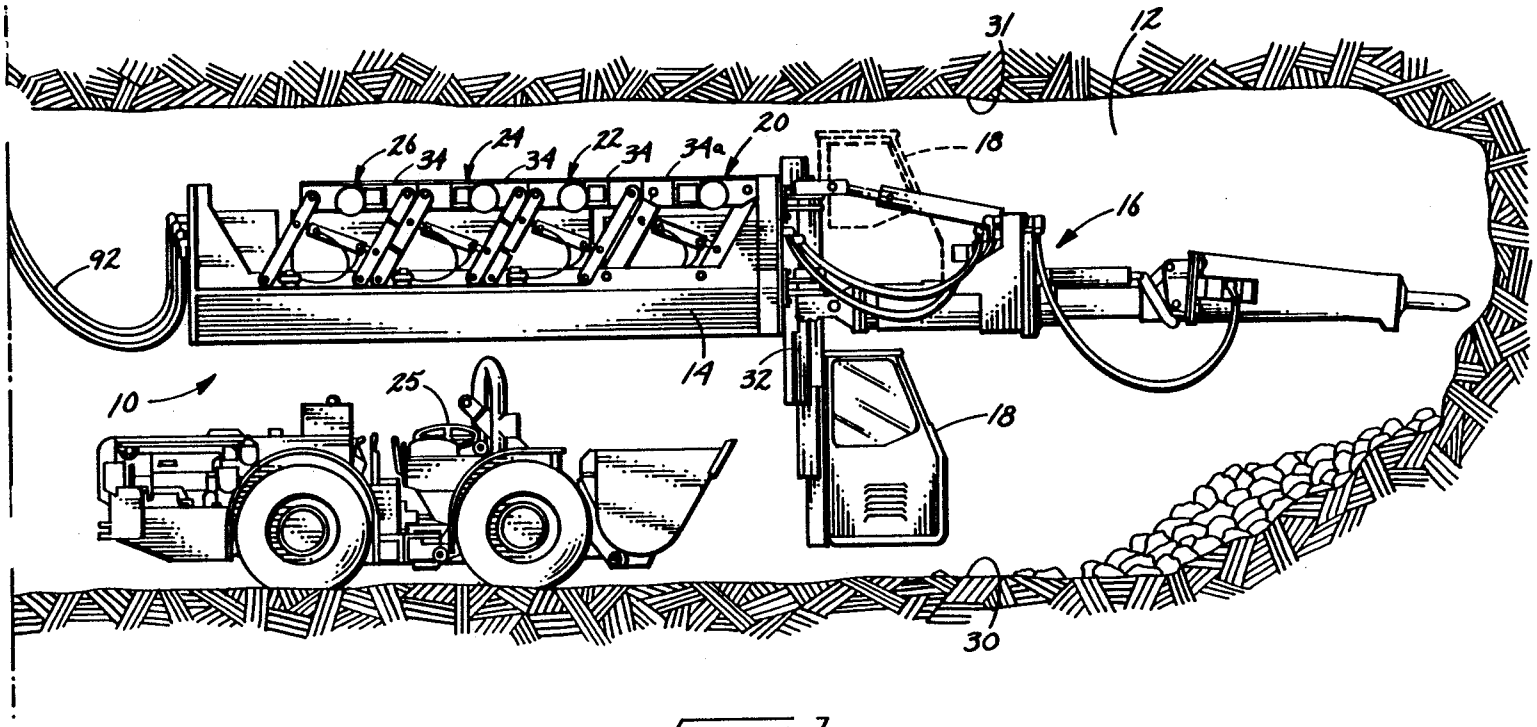
FIG. 1 is a side, longitudinal section view of a mine tunnel having a mining vehicle in accordance with the invention positioned therein. An independent load-haul-dump vehicle is also shown positioned beneath the mining vehicle.

The following disclosure of the invention is submitted in compliance with the constitutional purpose of the Patent Laws "to promote the progress of science and useful arts" (Article 1, Section 8).

The invention comprises an elongated mining vehicle which is self-supporting above the floor of a mine stope, tunnel, or cavity. In accordance with the invention, such a mining vehicle has an elongated carrier adapted for mounting a mining apparatus, such as a high energy hydraulic pick, at one end thereof. Transverse bracing means are included and are adapted to engage sidewalls of the mine tunnel for supporting the carrier above the tunnel floor. Suspension linkage means extends downwardly from the transverse bracing means for suspending the carrier beneath the transverse bracing means. The linkage means can be swung fore and aft with respect to the elongated carrier and bracing means for causing longitudinal movement of the carrier relative to the bracing means. This enables the mining vehicle to walk along a mining tunnel as is more fully developed below. The vehicle can be positioned such that rock removing vehicles can operate therebeneath when the tunnel sidewalls are engaged by the transverse bracing means. In this manner, material broken away by the hydraulic pick from the face of the tunnel can be easily removed from the tunnel.

Accordingly, such a vehicle is able to hold its position above a mine tunnel floor without contacting the floor. Such a vehicle is also able to walk for and aft on the tunnel walls. The vehicle is also able to move up or down by walking against the opposing tunnel walls. The vehicle is also able to change its heading for traveling along a curved mine tunnel.

The following discussion is divided into two parts: (1) a preferred embodiment of the construction of the vehicle; and (2) a description of the maneuverability of the vehicle. The reasons for some of the details of construction are most readily understood from the discussion of the maneuverability of the vehicle which follows.

CONSTRUCTION

Referring to FIGS. 1-5, a mining vehicle 10 is adapted for positioning within a generally horizontal mine tunnel 12. Mine tunnel 12 is generally rectangular in cross section having a pair of opposing sidewalls 28, a floor 30, and a ceiling 31. Mining vehicle 10 is comprised of a one piece, elongated frame or carrier 14 having a hydraulic pick assembly 16 mounted at the end designated as the front or forward end. Pick assembly 16 is adapted for movement in a plurality of directions for breaking rock at the face of the mine tunnel in which the vehicle is adapted to travel, and accordingly advance the tunnel. An operator's cage or cab 18 is also positioned at the forward end of carrier 14. It is mounted to one side of the end of carrier 14 while pick assembly 16 is mounted to the other side.

A transverse bracing means, in the form of four cap assemblies 20, 22, 24, 26, is adapted to engage mine tunnel sidewalls 28 above mine tunnel floor 30. A plurality of suspension links extend downwardly from each cap assembly for holding carrier 14 above mine tunnel floor 30. The components of the vehicle are constructed such that a rock removing vehicle 25 is operable beneath carrier 14. Operator's cab 18 includes a telescopic type mounting assembly 32 enabling it to be moved vertically for placing it out of the way of vehicle 25.

Cap assemblies 20, 22, 24, and 26 include an upper, generally rectangular portion 34 or 34*a*. Viewed from the top (FIG. 4), each of the rectangular portions of cap assemblies 20, 22, 24, and 26, appear to be of the same size. However, rectangular portion 34*a* of fore cap assembly 20 is of a sturdier, heavier construction than are each of rectangular portions 34 of the three aft cap assemblies 22, 24, and 26. In fact, the entirety of fore cap assembly 20 is of a sturdier construction than the three aft cap assemblies 22, 24, 26. The sturdier construction of the fore cap assembly maximizes the rigidity of the apparatus when mining.

Figure 4:
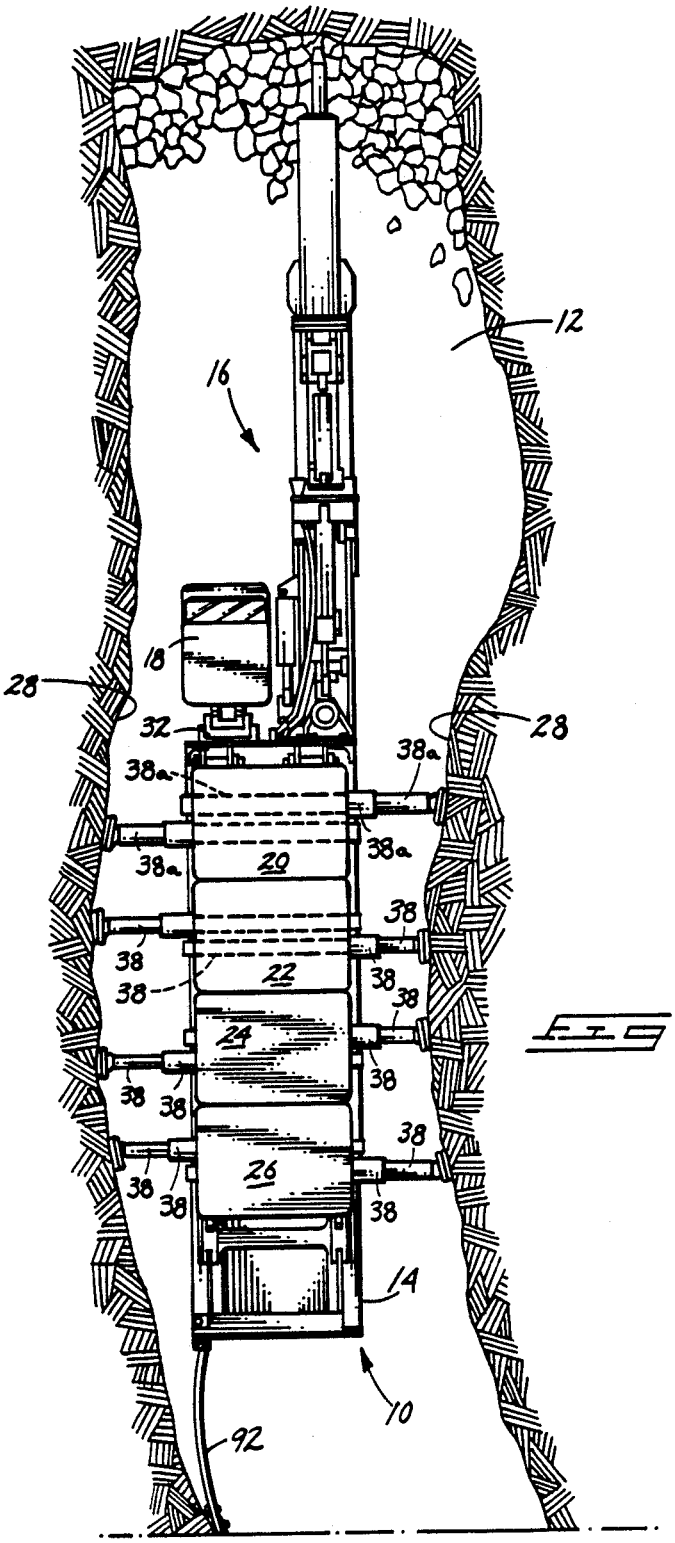
FIG. 4 is a top view of the mine tunnel and vehicle of FIG. 1.
Figure 5:
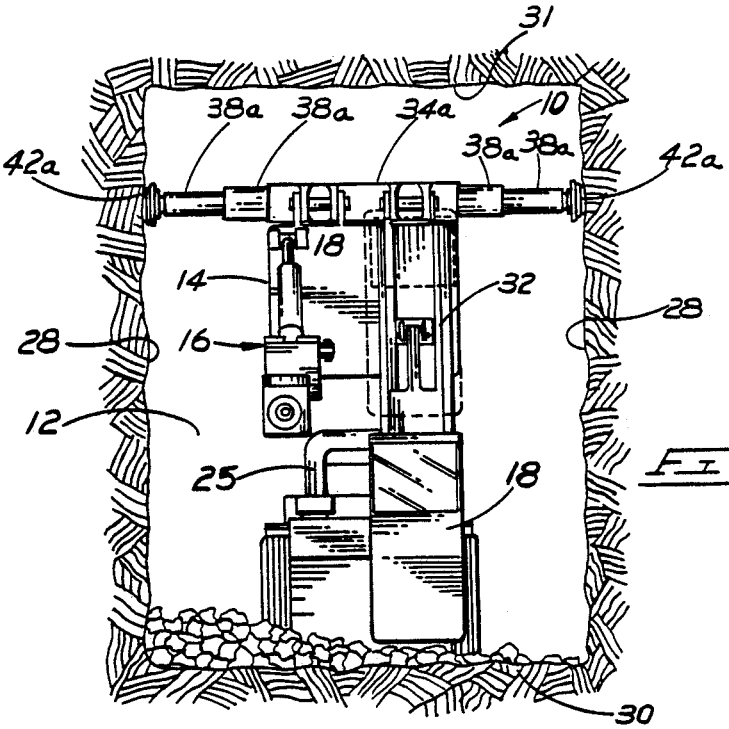
FIG. 5 is an end view of the mine tunnel and vehicle of FIG. 1.
Figure 6:
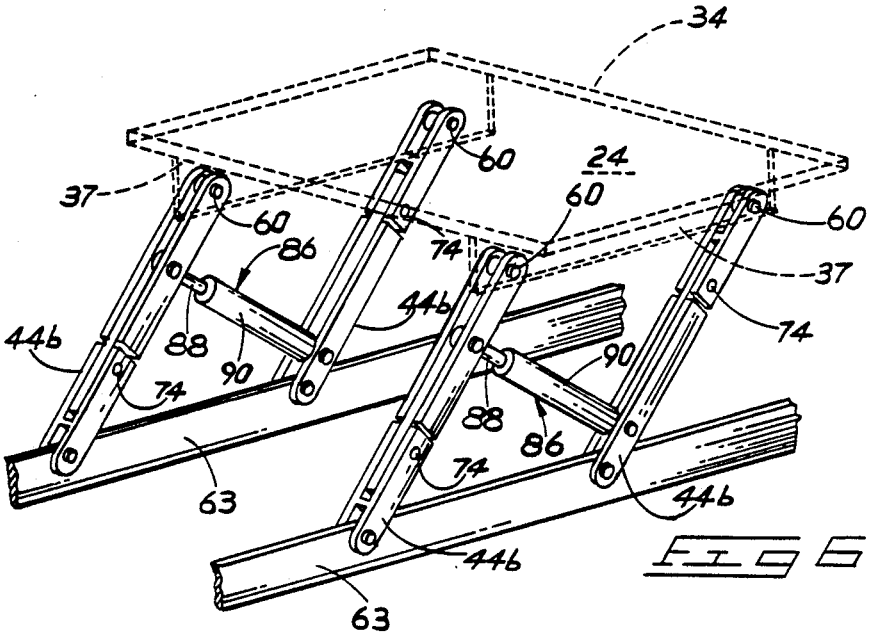
FIG. 6 is a fragmentary perspective view of a portion of a cap assembly and associated suspension linkage means of the mining vehicle in accordance with the invention.

Cap assemblies 20, 22, 24, and 26 have opposing pairs of transversely extending telescoping support assemblies 36 or 36*a* for engaging mine tunnel sidewalls 28. Assemblies 36, 36*a* are telescopic structural tubes or legs which may be round or square. Each of assemblies 36*a* of fore cap assembly 20 are, again, of heavier construction than assemblies 36 of the three aft cap assemblies. Each of assemblies 36 and 36*a* is comprised of several telescoping tubes 38, 38*a*, respectively. A foot member 42, 42*a* is pivotally connected at the outer end of the outer telescoping tube for engaging mine tunnel sidewalls 28. Foot members 42, 42*a* are constructed to be pivotal with respect to the outer telescoping tube to account for irregularities in tunnel sidewalls 28, as best shown in FIG. 4.

Inside each structural telescoping leg assemblies 36, 36*a* is a double acting hydraulic cylinder (not shown) which retracts the foot and leg, and extends the leg to apply force upon the foot when the foot contacts the mine tunnel wall. In this manner, assemblies 36, 36*a* push the leg assemblies outwardly against sidewalls 28 and support the cap assemblies above tunnel floor 30. A pressure sensor can be provided within each foot for an indication of a load bearing condition of the foot against the tunnel sidewalls.

Rectangular portions 34, 34*a* include extending plate like members 37, 37a respectively, through which telescoping support assemblies 36, 36*a* extend. In this manner, rectangular portions 34, 34*a* are supported by transverely extending leg assemblies 36, 36*a*, respectively.

Carrier 14 is connected to the cap assemblies by a plurality of suspension link members 44, 44*a*, and 44*b* which extend from the caps to the carrier. The suspension link members can alternately be considered or termed suspension or walking legs as each functions to impart a walking movement to the carrier or cap assembly to which each is connected. Four suspension link or leg members extend from the corners of each cap to carrier 14. Each of the link members is pivotally connected adjacent one of the four corners of the cap assembly, and also pivotally connected to elongated carrier 14. This creates two pairs of link members connected on respective right and left longitudinal halves of the carrier. Each pair forms a parallelogram with the carrier and cap assembly to which it is connected. Links 44*a* extend downwardly from fore cap assembly 20 and are again of heavier construction than the suspension links 44, 44*b* extending downwardly from the three aft cap assemblies 22, 24, 26. Suspension links 44*b* extending downwardly from the aft cap assemblies are variable in length while links 44 and 44*a* are not, as will be more fully described below.

Figure 2:
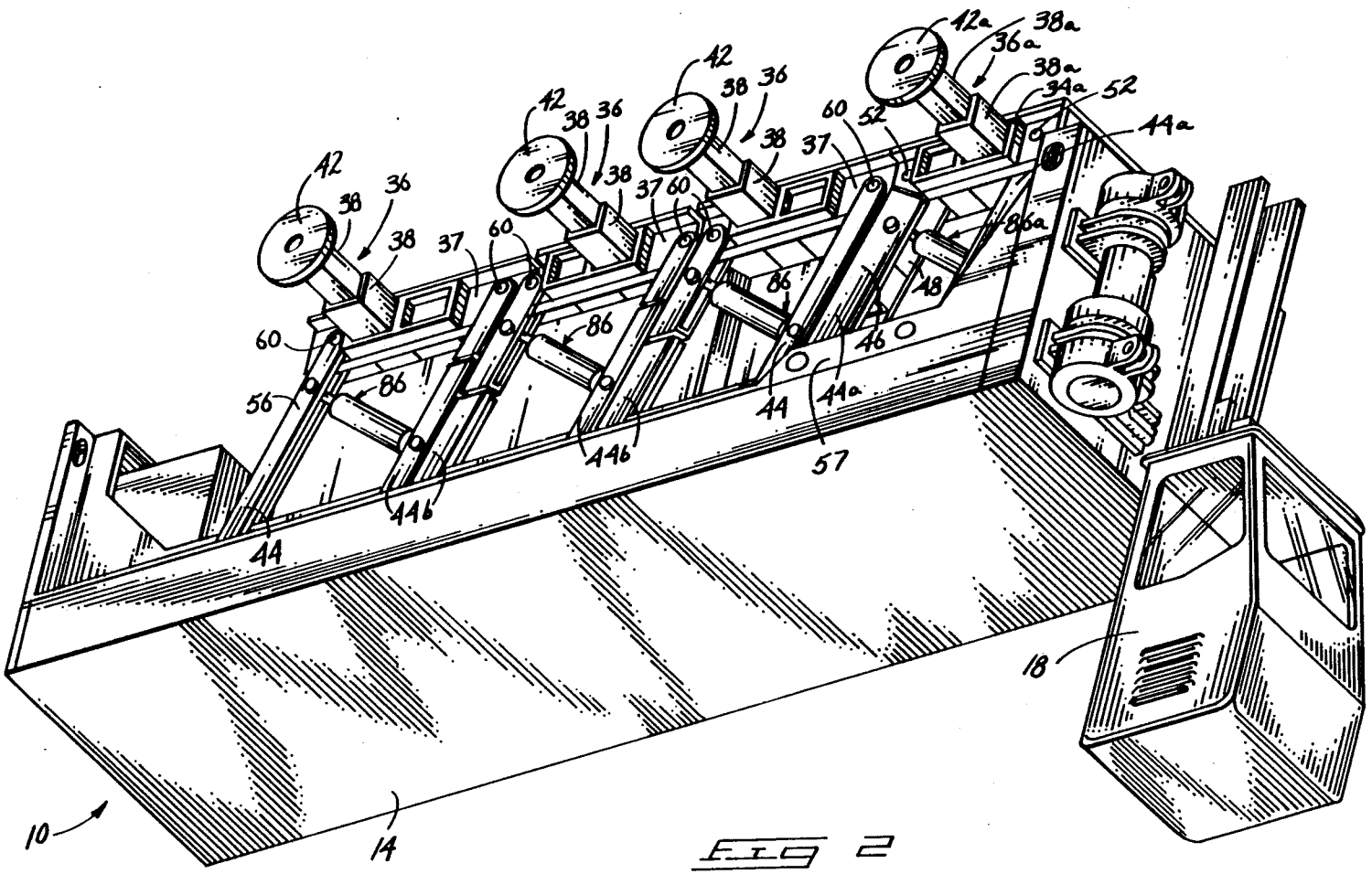
FIG. 2 is a bottom perspective view of the transport and support portions of the mining vehicle of FIG. 1.
Figure 3:
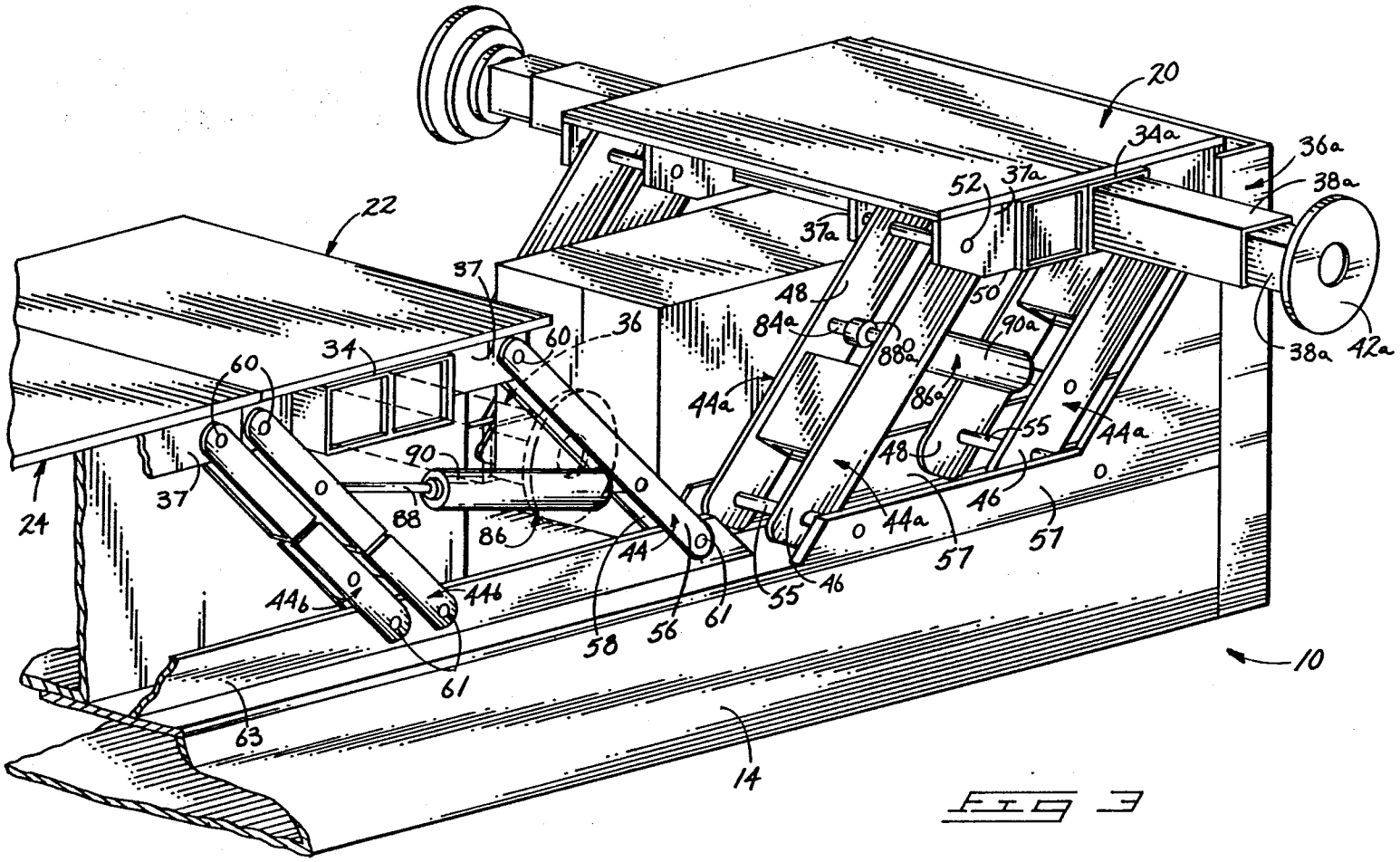
FIG. 3 is an elevated fragmentary perspective view of the forward part of the transport and support portion of the mining vehicle of FIG. 1.

Referring to FIGS. 2 and 3, each of suspension link members 44*a* extending from fore cap assembly 20 is comprised of a pair of interconnected plate like members 46, 48. One end of suspension links 44*a* is pivotally connected adjacent a corner of rectangular portion 34*a* by a pivot pin 52. Pivot pin 52 is received by a pair of plates 37*a* extending from rectangular portion 34*a*. Plates 37*a* also support piston and cylinder leg assemblies 36*a* as previously described. In this manner, links 44*a* are pivotal relative to cap assembly 20. The opposite end of each link 44*a* is connected to the forward end of carrier 14 by a pivot pin 55. Pivot pin 55 is received by a pair of plates 57 extending upwardly from carrier 14 for enabling pivotal movement of each of links 44*a* relative to carrier 14.

Referring to aft cap assemblies 22, 24, and 26, the rearwardmost pair of links 44 on cap assembly 26 and the forwardmost pair of links 44 of cap assembly 22 are of a fixed length. The forward pair of suspension links 44*b* of cap assembly 26, the aft pair of suspension links 44*b* of cap assembly 22, and all four of the suspension links 44*b* of cap assembly 24 are variable in length. Each is constructed to be compressible such that their lengths are reduced as needed for causing skewing of frame 14 relative to the three aft cap assemblies 22, 24, 26 to change the heading of the mining vehicle, as will be more fully described below.

Referring now to links 44, each is comprised of a pair of interconnected plate like members 56, 58. One end of each of links 44 is pivotally connected adjacent a corner of rectangular portion 34 of the cap assembly by a pivot pin 60 and associated spherical bearing 80 mounted in a plate 37 on cap assemblies 22, 26. In this manner, each suspension link 44 is pivotal relative to its respective cap assembly. The opposite end of each link 44 is connected to carrier 14 by a pivot pin 61. Pivot pin 61 is received by a spherical bearing 82 mounted in plate 63 on carrier 14 which extends upwardly between plate-like members 56, 58. In this manner, each of links 44 is also pivotal with respect to carrier 14.

Figure 7:
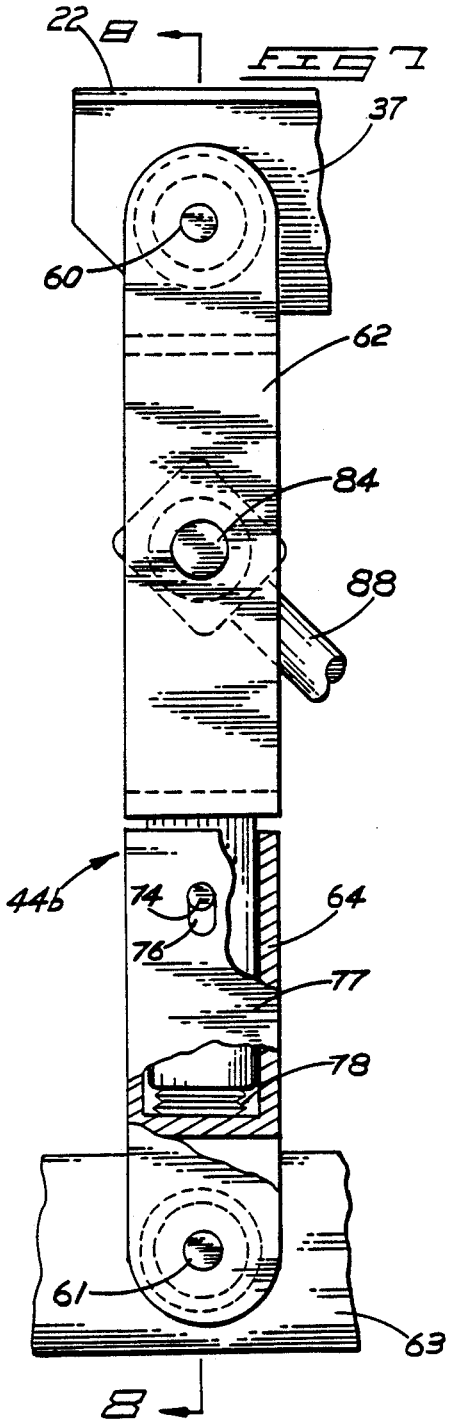
FIG. 7 is a side view of a compressible suspension link which is used in the mining vehicle of FIG. 1.
Figure 8:
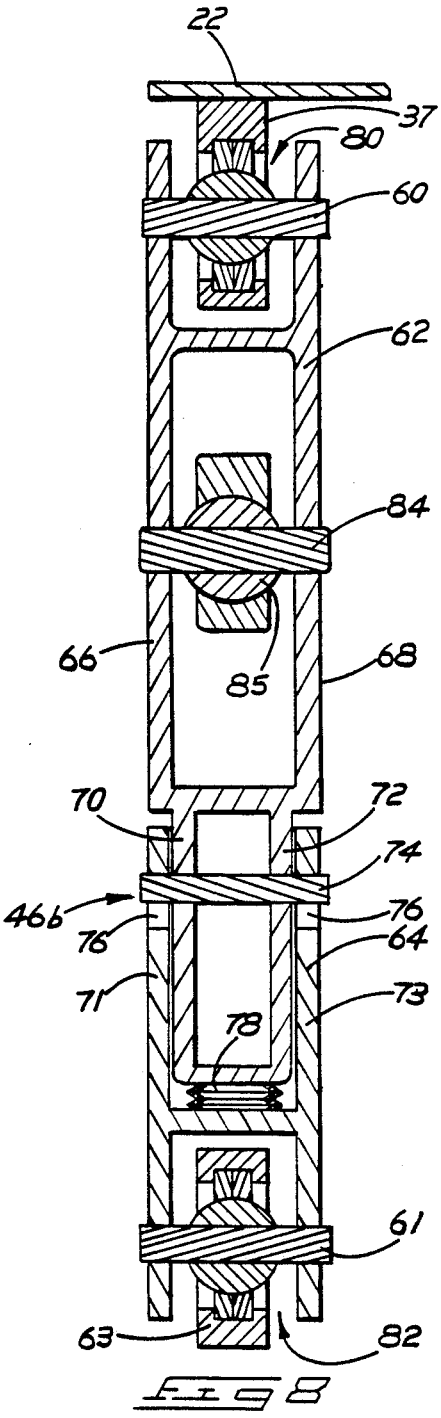
FIG. 8 is a section view taken along line 8—8 in FIG. 7.

Referring to compressible links 44*b* as shown in FIGS. 7 and 8, each can be considered as divided into an upper portion 62 and a lower portion 64. The upper part of upper portion 62 is constructed of a pair of interconnected, elongated plate-like members 66, 68. The lower part of upper portion 62 is comprised of a pair of interconnected, elongated plate-like members 70, 72, however, having a narrower overall width than the upper part of portion 62. A stout pin 74 extends laterally through plate-like members 70, 72 and extends outwardly therefrom. Lower portion 64 is comprised of four edge connected elongate plate-like members 71, 73, 75 (not shown), and 77. The four plate-like members form a central opening which is adapted to telescopically receive the lower narrow portion of upper portion 62. Pin 74 is slidably received within a pair of opposing elongate slots 76 formed in plate-like members 71, 73 of lower portion 64. A spring pack 78 is provided at the bottom of the central opening of lower portion 64 and bears against upper portion 62. Spring pack 78 serves to bias upper portion 62 and lower portion 64 from one another. In this manner, compressible links 44*b* are normally biased to their fully extended, elongate state, as shown in FIGS. 7 and 8. The lower portions of slots 76, and pin 74 receive therewithin, define the compressible extent of upper portion 62 within lower portion 64. The upper portion of slot 76 defines the resting portion against which pin 74 rests when no compressive force between a cap assembly and elongated carrier 14 is present.

As will be more fully described below, carrier 14 needs to skew with respect to the three aft cap assemblies 22, 24, and 26 to cause the vehicle to turn or change its heading. This skewing necessitates that suspension links 44 and 44*b* be able to pivot sidewardly with respect to plates 37 and 63. Accordingly, spherical bearing assemblies 80, 82 mounted in plates 37 and 63 are connected with pivot pins 60 and 61 at the ends of links 44 and 44*b* to enable pivotal motion about two axes, one axis being parallel to the plates, the other being perpendicular. Pivot pins 60, 61 in both of versions of suspension links 44, 44*b* extend through a spherical bearing assembly as all suspension links of the aft cap assemblies pivot laterally with respect to the carrier and caps when skewing movement occurs.

The pivot pins 52, 55 connecting links 44*a* to cap assembly 20 and carrier 14 are not required to be of a spherical bearing construction as pivoting is required only along one axis perpendicular to the rail.

For purposes of illustration, the mining vehicle 10 can be considered as divided into left and right longitudinal halves. Each cap assembly will then have a left and a right longitudinal pair of suspension links extending downwardly therefrom. A piston and cylinder assembly 86 and 86*a* extends between each left and right pair of suspension links for causing movement of each pair. As with the other components of fore cap assembly 20, its piston and cylinder assembly 86*a*, and associated components, is of a larger, sturdier construction than each of the piston and cylinder assemblies 86 of the aft three aft cap assemblies 22, 24, and 26.

Each piston and cylinder assembly 86, 86*a* is comprised of a piston 88 or 88*a* which is received by a cylinder 90 or 90*a*. One end of the piston and cylinder assembly 86 is connected to the upper half of a suspension link while the other end is connected to the lower half of a corresponding suspension link. Each end of assemblies 86 is pivotally connected to the suspension links 44 or 44*b* by a pivot pin 84 and spherical bearing assembly 85. This permits pivotal movement of assemblies 86 about two axes as is required when the carrier is caused to skew relative to the cap assemblies. The ends of assemblies 86*a* are pivotally connected to links 44*a* about one axis by pivot pins 84*a* received through sleeve-type bearings.

Referring again to FIG. 7, a piston rod 88 is shown pivotally connected to the upper half of an aft suspension link 44*b*. The fore suspension links 44*b* of cap assemblies 26 and 24 are of the same construction as that shown in FIG. 8, but are inverted (turned upside down) which places the pivotal cylinder connection in the lower half of the link.

With such a construction, extension and retraction of a pair of pistons 88 or 88*a* within cylinders 90 or 90*a* of a given cap assembly will cause the parallel links to swing. This causes a corresponding stepping movement of the cap assembly relative to carrier 14. Alternatively, with all telescoping leg assemblies firmly engaging tunnel sidewalls, extension or retraction of all piston cylinder assemblies 86, 86*a* simultaneously will cause carrier 14 to swing relative to the cap assemblies. In this manner, piston and cylinder assemblies 86 and 86*a* provide a movement means for causing pivotal movement of the ends of the suspension links about each cap assembly and elongated carrier 14.

For purposes which will be more fully described below, each of the piston cylinder assemblies is separately operable from other such assemblies. Hydraulic circuitry well known in the art is also employed to enable simultaneous movement of all of the left longitudinal piston and cylinder assemblies independent of the right assemblies, for reasons which will also be more fully described below.

The utilities (electricity, water, and compressed air) are supplied through lines 92 which operably connect at the rear end of carrier 14. The hydraulic system is integrated into carrier 14.

MANEUVERING

The apparatus of the present invention has the ability to move up and down, fore and aft, and change its heading by sequentially stepping the cap assemblies to different positions. The direction and distance movable in a single step is a function of the suspension linkage angular displacement from the vertical or plumb position.

However, when the machine is configured to work, all of the cap assemblies are positioned parallel and touching. The feet of each assembly are set against the sidewalls with a load bearing force applied.

Fore and Aft Travel

Figure 9:
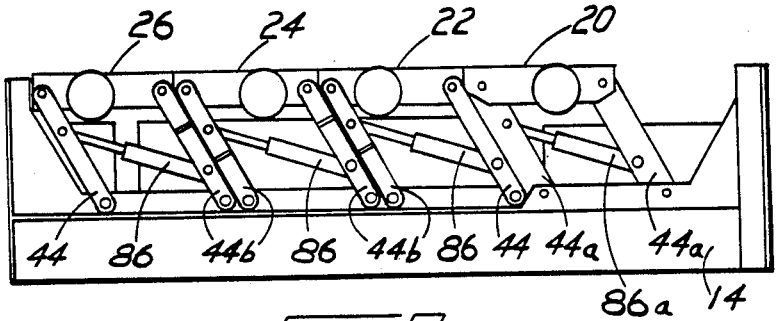
FIGS. 9, 10 and 11 are side views of the transport portion of the mining vehicle shown in three different operative positions.
Figure 10:
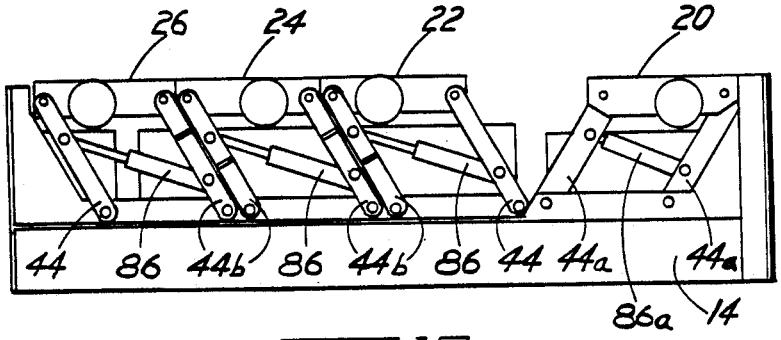

The procedure to move or walk the assembly fowardly is started with all feet 42, 42*a* applying a load bearing force against sidewalls 28, and all cap assemblies touching. Carrier 14 is swung into the full forward position by simultaneously extending all pistons 88, 88*a* of assemblies 86, 86*a* simultaneously, as shown in FIG. 9. This achieves maximum angular displacement of the suspension links. At this point, the hydraulic pressure holding the transverse legs of fore cap assembly 20 against the sidewalls is released, and the legs retracted so that feet 42*a* clear the sidewalls. The left and right piston and cylinder assemblies 86*a* of cap assembly 20 then retract causing the links 44*a* to step to the full forward angular displacement position, as shown in FIG. 10. In this position, the legs of cap assembly 20 are extended to firmly engage and set feet 42*a* against the mine tunnel sidewalls.

Figure 11:
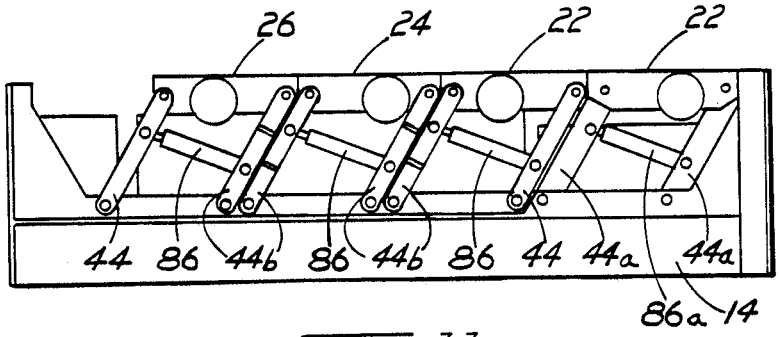

After the feet are so set, the pistons or legs of the next adjacent cap assembly 22 are retracted to clear its feet 42 from the tunnel sidewalls. Cap assembly 22 then steps forward, using its associated piston and cylinder assemblies 86, to touch cap assembly 20. The legs of cap assembly 22 are then fully extended to set its feet 42 against the tunnel sidewalls. Cap assemblies 24 and 26 are separately stepped forward in a similar fashion. At this point the transport assembly will appear as shown in FIG. 11. To continue forward movement, the carrier is swung forward full stroke by simultaneously extending all pistons and cylinder assemblies 86, 86*a*, and the procedure repeated.

To walk in the opposite direction, the procedure begins by swinging the carrier full backstroke, then stepping cap assembly 26 rearwardly, followed by caps 22 and 24, and finally cap 20. Small fore or aft movements can be made by displacing the pairs of link members a shorter distance on either side of plumb.

To transport the vehicle great distances along a mine tunnel, a powered dolly can be used to move the vehicle.

Up and Down Travel

Figure 13:
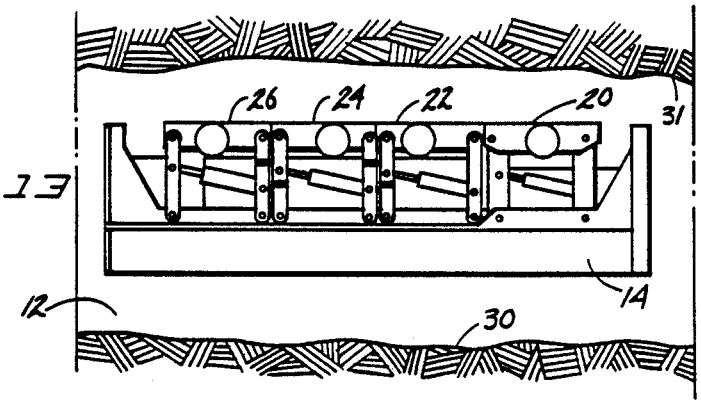
FIG. 13 is a side view of the vehicle as positioned in FIG. 12.

For downward movemnt, the carrier is first positioned with the suspension links in the plumb position, as shown in FIG. 13. The legs of first cap assembly 20 are then retracted and the cap stepped to a maximum forward displacement with its feet set against the sidewalls. In such a position (not shown), cap 20 is positioned vertically lower relative to the positions of caps 22, 24 and 26. With cap 20 in its full forward angular displacement position, caps 22, 24, and 26 are sequentially stepped down and their associated feet set against the sidewalls. The carrier is then positioned such that all links are plumb which effectively lowers carrier 14 within the mine tunnel. To continue downward movement, the stepping sequences are repeated. With such a sequence, the apparatus is caused to move downward in an angularly forward fashion. To move downwardly in an angularly rearward fashion, the sequence is started by first swinging aft cap assembly 26 rearward.

To move the mining apparatus upwardly, the carrier assembly is swung forward (or rearward) to achieve maximum angular displacement of the suspension links from plumb, as shown in FIG. 8. When swung forward, the legs of cap assembly 20 are then retracted and the cap stepped so that its suspension links are plumb. Its feet are then set against the sidewalls. In this position (not shown), cap 20 will be positioned higher than the positions of caps 22, 24, and 26. The remaining caps are then stepped upwardly in sequence until the procedure is complete. When the carrier 14 is then again swung full forward (or rearward) it will be raised within the tunnel. The stepping sequences can then be repeated. With such a sequence, the apparatus is caused to move upwardly in an angularly forward fashion.

As stated, if the stepping sequences are repeated in either of the above methods in the same direction, mining vehicle 10 moves horizontally as well as vertically. In other words, the apparatus either angles upwardly or downwardly. If the initial position and stepping sequences are alternated fore and aft after each vertical walking procedure, the mining vehicle will only move up or down within the limits of the horizontal displacement effecting each vertical step.

Turning

Figure 12:
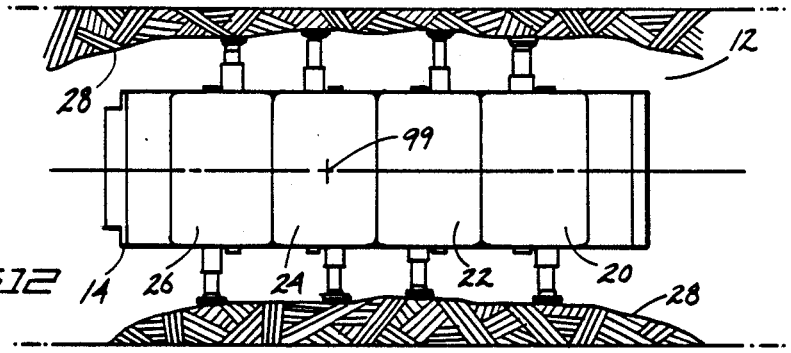
FIGS. 12, 14, and 16-19 are sequential top plan views of the mining vehicle shown in FIG. 1 illustrating how the vehicle is able to change its heading.

Turning of the mining apparatus 10, for making it change its heading to follow a curved tunnel, will best be understood with reference to FIGS. 12–20. Turning is effected by first skewing the elongated carrier relative to the transverse bracing means. To begin the turning motion, the apparatus is first positioned as shown in FIGS. 12 and 13. All of the transverse bracing legs are out in extended positions with the feet set against the sidewalls with force applied. The cap assemblies 20, 22, 24 and 26 are side by side and touching, then the suspension links are positioned to be plumb. The feet of fore cap 20 are then retracted from the sidewalls roughly eight to ten inches. Cap 20 is then stepped forward two to three inches which places its suspension links four to six degrees fowardly out of plumb. Thereafter, the hydraulic circuitry of cap 22 and cap 26 are changed to what is referred to as a "float" condition. In the "float" condition, the feet of a cap assembly apply force to the sidewalls. However, the cavities of both leg hydraulic cylinders are valved to communicate fluid. Accordingly, the cap assembly is firmly suspended between the side walls by the oppositely engaged feet, yet remains laterally movable if an external lateral force is applied to the cap assembly.

Figure 14:
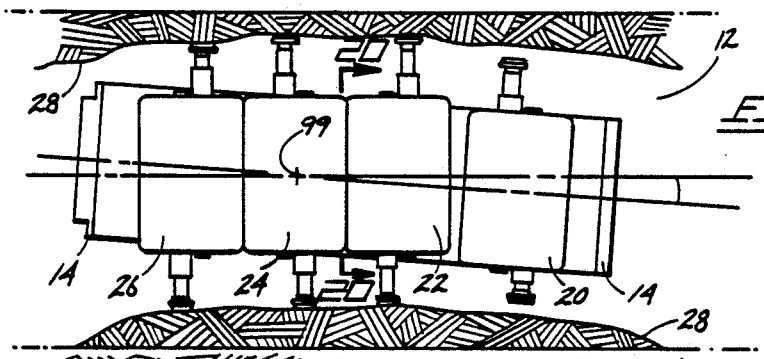
Figure 15:
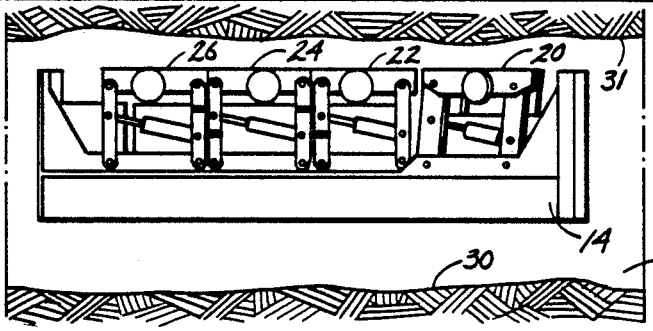
FIG. 15 is a side view of the vehicle as positioned in FIG. 14.

In this position with cap assemblies 22, 26 in the float condition, with the middle cap 24 in the locked or "stiff" position, carrier 14 can be caused to skew about point 99 relative to the longitudinal axis of contacting caps 22, 24 and 26. Turning to the right, as shown, is effected by simultaneously slightly extending the piston and cylinder link assemblies on the right longitudinal half of the vehicle while slightly retracting the piston and cylinder assemblies on the left longitudinal half of the vehicle. When this task is performed, the mining apparatus will be positioned as shown in FIGS. 14 and 15.

This skewing movement will cause all compressible suspension links 44*b* to shorten as required relative to suspension links 44. At the same time, because of this foreshortening, carrier 14 will be caused to be raised slightly upwardly in the mine tunnel. The need for spherical bearing assemblies at both ends of the suspension links 44 and 44*b* and piston cylinder assemblies 86 will readily be apparent from FIG. 20. The skewing action causes sideward or lateral pivotal movement of each of the suspension links and piston cylinder assemblies about both of their respective pivotally connected ends. The fore and aft end pairs of fixed links 44 are caused to move sidewardly the greatest distance by the skewing action.

Figure 16:
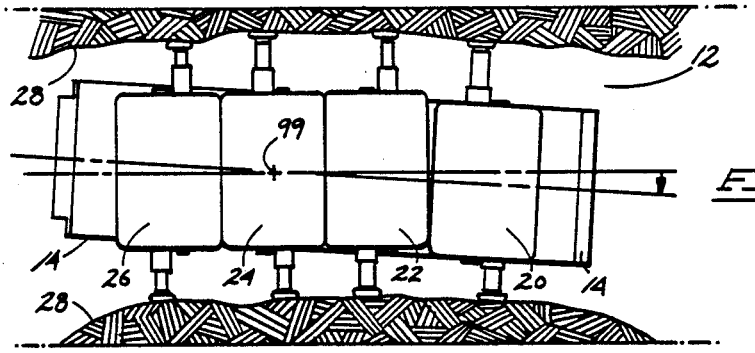

At this point, the hydraulic circuitry in caps 22, 26 is returned to the locked or "stiff" position to prevent any subsequent lateral movement. Forward cap 20 is then caused to step rearwardly to the point where it just touches cap 22. The legs of cap 20 are then extended and its feet set against sidewalls 28. The mining apparatus will then be positioned as shown in FIG. 16.

Figure 17:
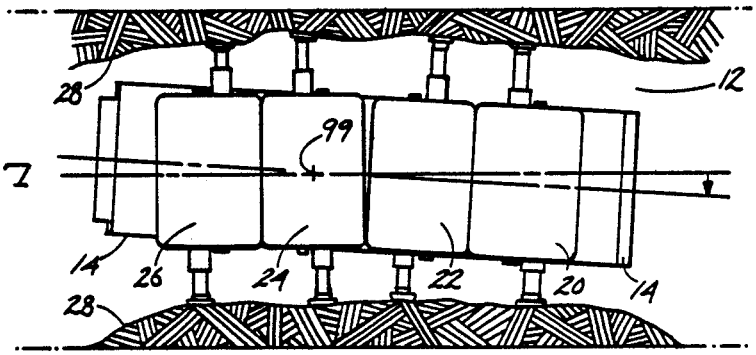
Figure 18:
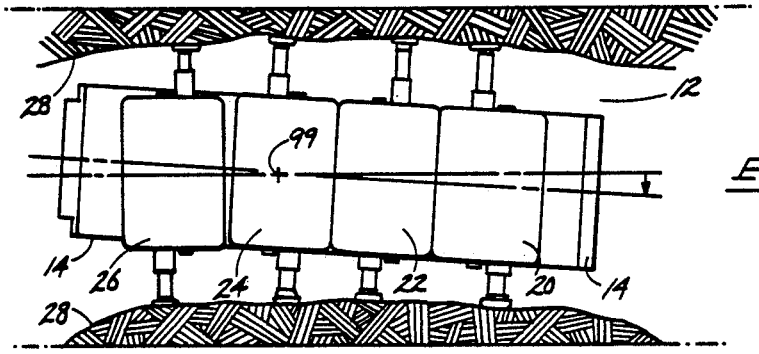
Figure 19:
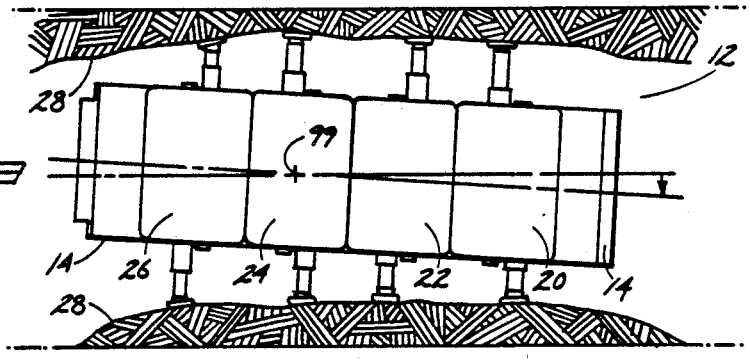
Figure 20:
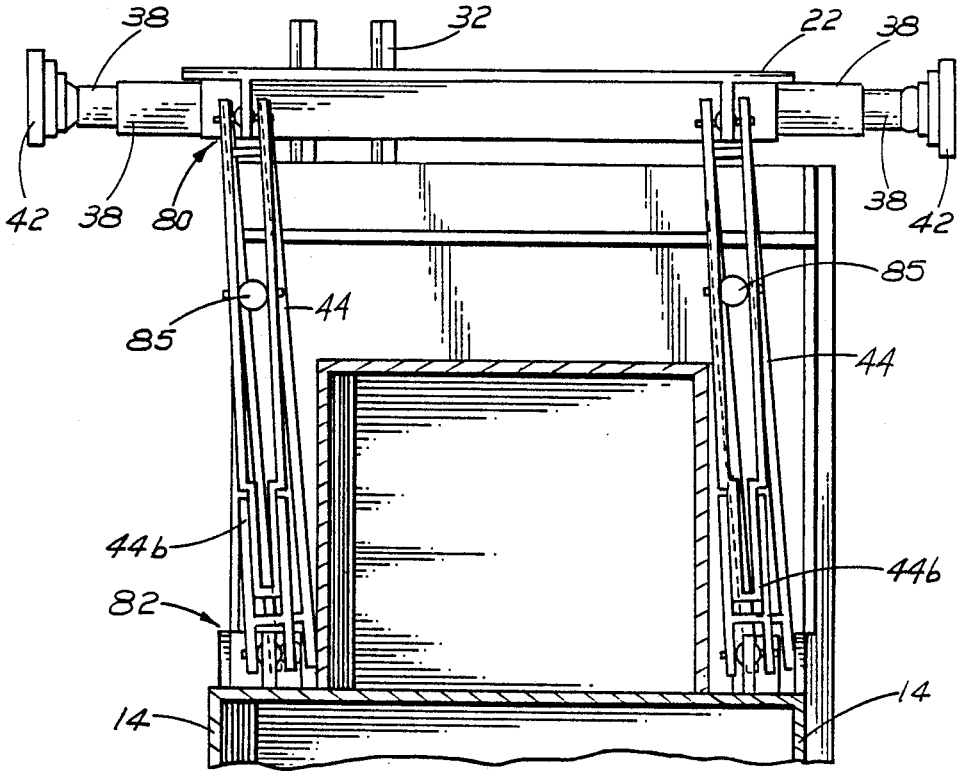
FIG. 20 is an end section view taken along line 20—20 in FIG. 14.

Now the feet of cap 22 are slightly retracted from the sidewalls. The left and right linkage pairs of cap 22 are then independently caused to twist cap 22 into a parallel position relative to cap 20, and stepped forward to touch cap 20. The legs of cap 22 are then extended and its feet set against sidewalls 28. The vehicle will then be configured as shown in FIG. 17. Cap 24 is similarly stepped forward whereby the apparatus will be configured as shown in FIG. 18. The procedure is completed by similarly stepping cap 26 forward as shown in FIG. 19. At this point the sequence is complete, but can be repeated if necessary to increase the heading change.

In compliance with the statute, the invention has been described in language more or less specific as to structural features. It is to be understood, however, that the invention is not limited to the specific features shown, since the means and construction herein disclosed comprise a preferred form of putting the invention into effect. The invention is, therefore, claimed in any of its forms or modifications within the proper scope of the appended claims, appropriately interpreted in accordance with the doctrine of equivalents.

I claim:

1. A mining vehicle comprising:

an elongated carrier;

means for mounting a mining apparatus to an end of the carrier;

transverve bracing means adapted to engage side walls of a mine tunnel for supporting the elongated carrier above the floor of a mine tunnel, the transverse bracing means including at least one pair of transverse extendible legs protruding in opposite directions, the extendible legs adapted to engage opposite side walls of a mine tunnel for supporting the elongated carrier above the mine tunnel floor;

suspension linkage means extending downwardly from the transverse bracing means for suspending the elongated carrier beneath the transverse bracing means, said suspension linkage means being longitudinally movable with respect to the elongated carrier and transverse bracing means for causing longitudinal movement of the elongated carrier and transverse bracing means relative to one another;

the transverse bracing means and elongated carrier each including left and right longitudinal halves;

the suspension linkage means comprising left linkage means and right linkage means linking the respective left and right longitudinal halves of the transverse bracing means with the elongated carrier, the left linkage means and right linkage means being independently movable for skewing the elongated carrier relative to the transverse bracing means to turn or cause the vehicle to change heading enabling the vehicle to traverse a curved portion of a mine tunnel; and the left and right linkage means each comprising a pair or suspension links positioned parallel with respect to one another, one end of each link being pivotally connected to the transverse bracing means, the other end of each link being pivotally connected to the elongated carrier.

2. A mining vehicle comprising:

an elongated carrier;

means for mounting a mining apparatus to an end of the carrier;

transverse bracing means adapted to engage side walls of a mine tunnel for supporting the elongated carrier above the floor of a mine tunnel;

suspension linkage means extending downwardly from the transverse bracing means for suspending the elongated carrier beneath the transverse bracing means, said suspension linkage means being longitudinally movable with respect to the elongated carrier and transverse bracing means for causing longitudinal movement of the elongated carrier and transverse bracing means relative to one another;

the transverse bracing means and elongated carrier each including left and right longitudinal halves;

the suspension linkage means comprising left linkage means and right linkage means linking the respective left and right halves of the transverse bracing means with the elongated carrier, the left linkage means and right linkage means being independently movable for skewing the elongated carrier relative to the transverse bracing means;

the left and right linkage means each comprising a pair of suspension links positioned parallel with respect to one another, one end of each link being pivotally connected to the transverse bracing means, the other end of each link being pivotally connected to the elongated carrier; and powered piston and cylinder means operatively connected to each of the left and right pairs of suspension links for independently causing movement of each pair.

3. A mining vehicle comprising:

an elongated carrier;

means for mounting a mining apparatus to an end of the carrier;

transverse bracing means adapted to engage side walls of a mine tunnel for supporting the elongated carrier above the floor of a mine tunnel;

suspension linkage means extending downwardly from the transverse bracing means for suspending the elongated carrier beneath the transverse bracing means, said suspension linkage means being longitudinally movable with respect to the elongated carrier and transverse bracing means for causing longitudinal movement of the elongated carrier and transverse bracing means relative to one another;

the transverse bracing means comprising:

a plurality of cap assemblies each having a pair of transverse extendible legs protruding in opposite directions thereform, the extendible legs adapted to engage opposite side walls of a mine tunnel for supporting the cap assemblies above the floor of a mine tunnel; and the linkage means comprising:

at least four suspension links extending forwardly from each cap assembly, each suspension link being pivotally connected to a cap assembly at one of its ends and pivotally connected to the elongated carrier at the other of its ends; and movement means associated with the suspension links of each cap assembly for independently causing pivotal movement of the ends of the suspension links relative to each cap assembly and the elongated carrier for moving each cap assembly and the carrier relative to one another.

4. The mining apparatus of claim 3 wherein the extendable legs include pressure sensing means at the other ends thereof for sensing whether an extended leg is bearing with force against a wall of a mine tunnel.

5. The mining vehicle of claim 3 wherein, the cap assemblies each comprise first and second opposite transverse sides, the four suspension links extending from each cap assembly to the elongated carrier extending in the first and second pairs from the respective first and second transverse sides of the cap assembly, the suspension links in each pair being parallel to one another, and wherein the movement means comprises powered piston and cylinder means operatively connected to the suspension link pairs for causing parallel movement of the suspension links of each pair about the pivotally connected ends.

6. The mining vehicle of claim 5 wherein the movement means comprises a separate independently operable piston and cylinder means operably connected to each of the first and second pairs of suspension links.

7. The mining vehicle of claim 6 wherein a plurality of the suspension links are variable in length.

8. The mining vehicle of claim 5 wherein each suspension link member comprises an upper half and a lower half, the piston and cylinder means being connected between the suspension links of at least one of the first and second pairs, the piston and cylinder means including a piston and cylinder which are connected to opposite upper and lower halves of the suspension links of the at least one pair.

9. The mining vehicle of claim 3 wherein each of the transversely protruding legs includes a foot member pivotally connected to an outer end thereof for engagement with the sidewalls of a mine tunnel.

10. The mining vehicle of claim 3 wherein the plurality of separate cap assemblies number four.

11. A mining vehicle comprising:

an elongated carrier;

means for mounting a mining apparatus to an end of the carrier;

first transverse bracing means adjacent the mining apparatus mounting means, the first transverse bracing means adapted to engage side walls of a mine tunnel for supporting the elongated carrier above the floor of a mine tunnel, the first transverse bracing means including at least one pair of transverse extendible legs protruding in opposite directions, the extendible legs adapted to engage opposite side walls of a mine tunnel for supporting the elongated carrier above the mine tunnel floor;

second transverse bracing means positioned behind the first transverse bracing means, the second transverse bracing means comprising at least three separate transverse bracing units, each transverse bracing unit including at least one pair of transverse extendible legs protruding in opposite directions, the extendible legs adapted to engage opposite side walls of a mine tunnel for supporting the elongated carrier above the mine tunnel floor; and linkage means extending downwardly from each of the first transverse bracing means and at least three transverse bracing units whereby the first transverse bracing means and at least three transverse bracing units are each independently linked to the elongated carrier, each linkage means being pivotally connected to the elongated carrier and respective first bracing means or bracing unit.

12. A mining vehicle comprising:

an elongated carrier;

means for mounting a mining apparatus to an end of the carrier;

first transverse bracing means adjacent the mining apparatus mounting means, the first transverse bracing means adapted to engage side walls of a mine tunnel for supporting the elongated carrier above the floor of a mine tunnel;

second transverse bracing means positioned behind the first transverse bracing means, the second transverse bracing means comprising at least three separate transverse bracing units;

linkage means extending downwardly from each of the first transverse bracing means and at least three transverse bracing units whereby the first transverse bracing means and at least three transverse bracing units are each independently linked to the elongated carrier, each linkage means being pivotally connected to the elongated carrier and respective first bracing means or bracing unit;

the first transverse bracing means, three transverse bracing units, and elongated carrier each including left and right longitudinal halves; and the linkage means comprises a left linkage means and right linkage means linking the respective left and right halves of the first transverse bracing means and at least three transverse bracing units with the elongated carrier, the left linkage means and right linkage means being independently movable for skewing the elongated carrier relative to the first and second transverse bracing means, at least portions of the left and right linkage means being length adjustable.

* * * * *